United States Patent [19]

Masuda

[11] Patent Number: 4,998,088

[45] Date of Patent: Mar. 5, 1991

[54] VARIABLE RESISTOR AND MANUFACTURING METHOD FOR THE SAME

[75] Inventor: Fumitoshi Masuda, Nagaokakyo, Japan

[73] Assignee: Murata Manufacturing Co., Ltd., Kyoto, Japan

[21] Appl. No.: 359,715

[22] Filed: May 31, 1989

[30] Foreign Application Priority Data

Jun. 6, 1988 [JP] Japan ..... 63-139110

[51] Int. Cl.[5] ..... H01C 10/32

[52] U.S. Cl. ..... 338/162; 338/164

[58] Field of Search ..... 338/162, 164, 199, 275, 338/171

[56] References Cited

U.S. PATENT DOCUMENTS 3,518,604 6/1970 Beaver et al. ..... 338/164

4,565,990 1/1986 Matsui et al. ..... 338/171

*Primary Examiner*—Bruce A. Reynolds

*Assistant Examiner*—Marvin M. Lateef

*Attorney, Agent, or Firm*—Wenderoth, Lind & Ponack

[57] ABSTRACT

A variable resistor and a method for manufacturing the same is disclosed in which the variable resistor includes a casing having a bottom wall and a plurality of sidewalls extending from the bottom wall to define an opening of the casing. An insulating substrate is provided having a first surface formed along the bottom wall of the casing and a second surface opposite the first surface facing the opening of the casing. A curved resistor layer and a centrally disposed collector electrode layer are formed on the second surface of the insulating substrate. A rotor member is rotatively disposed within the casing such that its rotation axis extends through the centrally disposed collector layer. A slidable member is connected to the rotor member and is slidably connected to the curved resistor layer and the collector electrode layer for electrically connecting the curved resistor layer and the collector electrode layer. The rotor member is secured within the casing by the sidewalls which are molded to extend inwardly towards the rotational axis defined by the rotor member.

20 Claims, 3 Drawing Sheets

VARIABLE RESISTOR AND MANUFACTURING METHOD FOR THE SAME

BACKGROUND OF THE INVENTION

The present invention relates to a variable resistor and manufacturing method for the same, and more particularly, to a case-type variable resistor having main parts housed in an insulating case and a manufacturing method for the same.

FIGS. 7 and 8 show the conventional case-type variable resistor in which the insulating substrate 2 is provided on the surface thereof with the arched resistor 4 and with the collector electrode 6 at the center of the arched resistor 4 respectively, the resistor 4 being connected electrically at both ends thereof to the terminals 8 and 9 and the collector electrode 6 to the terminal 10, respectively.

To the concave portion of the rotor 14, formed at the bottom surface of the rotor 14, is secured the sliding member 12. A convex portion 14*a* and the driver-engaging groove 14*b* are formed at the upper part of the rotor 14. The sliding member 12 slides on the resistor 4 and the collector electrode 6.

Reference numeral 18 designates the case, to whose lower opening is fixed the substrate 2. Inside the case, the rotor 14, to which the sliding member 12 is secured, is rotatably held on the substrate 2 with the packing 16 on the shoulder part thereof.

The case 18 also has an opening at its upper surface exposing the convex part 14*a* of the rotor 14 to the outside of the case 18.

The packing 16 serves not only to seal the inside of the case but also to control the rotating torque of the rotor 14.

Reference numeral 20 designates seal resin made of thermosetting epoxy resin and the like, obtained through potting, heating and curing thereof, to retain the rotor 14 within the case 18 and at the same time to secure thereto the substrate 2. The resin 20 also functions to enhance the sealing effect.

In this variable resistor, when the rotor 14 is rotated to right or left using its driver-engaging groove 14*b*, the sliding member 12 slides on the resistor 4 and the collector electrode 6 with the result that the resistance value between the terminal 10 and terminal 8 or 9 can be changed.

However, in such a variable resistor as above-described, various problems have been caused by using a seal resin 20 for holding the rotor 14 in the case 18, securing the substrate 2 thereto and making the inside of the case air-tight. For example, if the seal resin 20 is injected excessively, a flat bottom surface can not be obtained, thus causing difficulty in being secured to the printed substrate and the like, while an insufficient amount of injection results in imperfect airtightness. Accordingly, controlling the amount of injection is so difficult that it has become a barrier to an automatic assembling of the component.

In addition, it takes so much time in curing the seal resin 20 by applying heat that productivity has not been improved and manufacturing arrangements heavily-equipped.

Furthermore, in the seal-type case having the packing 16, heat applied to cure the seal resin 20 causes inner pressure to go up within the case, with the result being that air therein leaks to the outside of the case 18 through a hole forced open in the resin 20. This has also been a barrier to an automatic assembling.

SUMMARY OF THE INVENTION

Accordingly, it is an object of the present invention to provide a variable resistor and manufacturing method for the same capable of functioning without the use of the seal resin to house the substrate and the rotor into the case, thereby eliminating delicate controlling of injection amount and heating for curing the seal resin, and also preventing a hole from being made in resin due to the increased internal pressure.

It is another object of the present invention to provide a variable resistor and manufacturing method for the same superior in productivity, simple in manufacturing arrangements and easy to assemble in an automatic manner.

DESCRIPTION OF THE PREFERRED EMBODIMENT

Figure 1:
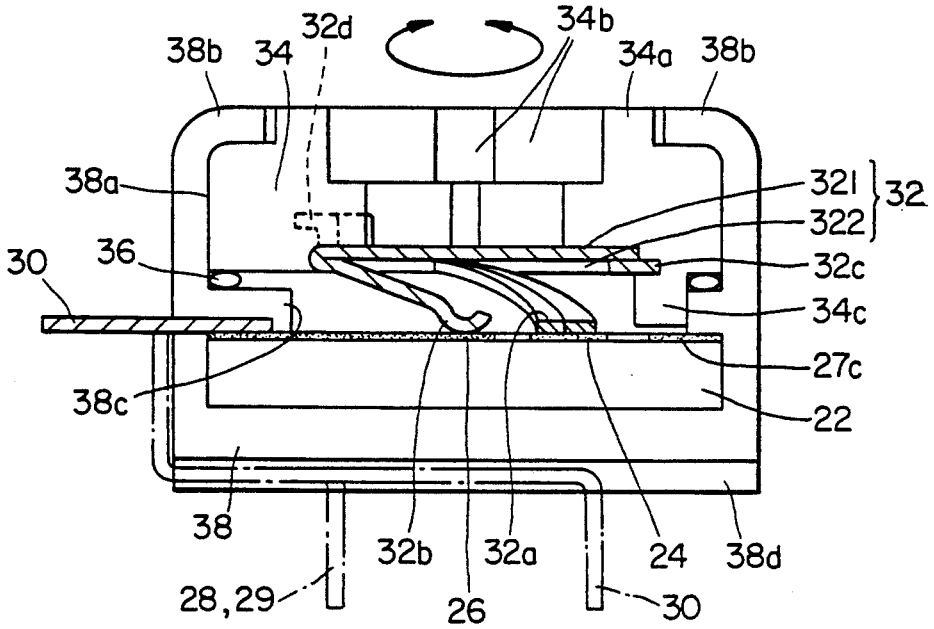
FIG. 1 is a vertical section showing one example of a variable resistor according to the present invention.

The construction of a variable resistor according to the present invention is shown in FIG. 1 and is explained below in accordance with its manufacturing method.

Figure 2:
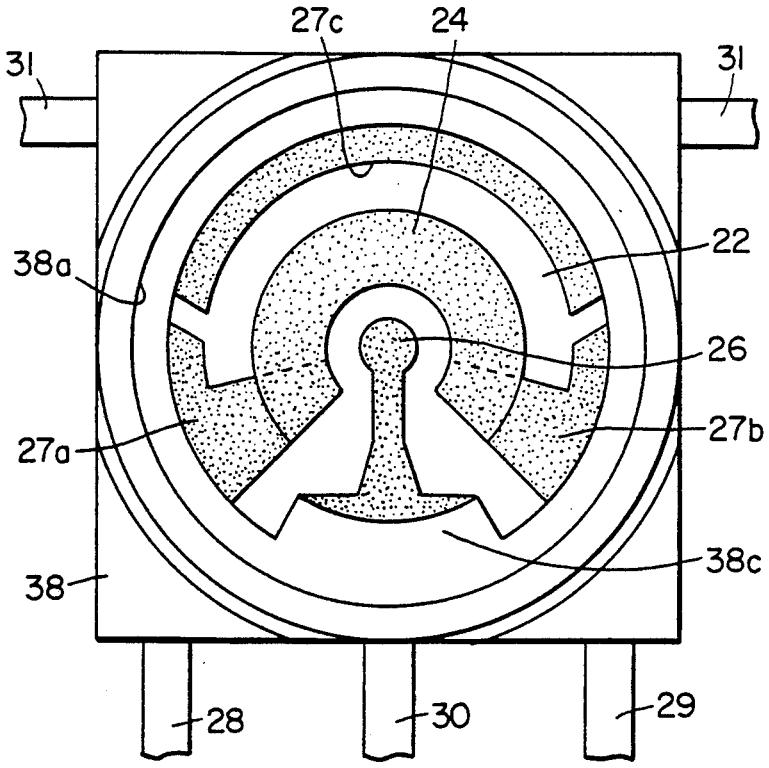
FIG. 2 is a transverse plan view showing a case and a substrate used for a variable resistor in FIG. 1.

First, the case 38 side is described referring also to FIG. 2. The insulating substrate 22 is provided having formed on the surface thereof the arched (curved) resistor 24, and the collector electrode 26, are formed, and three terminals 28, 29 and 30 are connected thereto by means of soldering, welding and the like. The terminal 28 is electrically connected to one end of the resistor 24 through the electrode 27*a*, terminal 29 to the other end through 27*b*, and terminal 30 to the collector electrode 26, respectively.

Next, the substrate 22 is molded at the bottom of the case 38 with some portions of each terminal 28, 29 and 30 extending to the outside thereof and in such a manner as to make the resistor 24 side on top. The case 38 is made of an insulating resin and has the circular opening 38*a* to house the rotor 34 to be described later.

The case 38 is preferably made of thermoplastic resin, for example, PBT resin, easy to be molded by heat and lower in deforming temperature than the resin of the rotor 34 to be described later (for example, PPS resin). Reasons for this will also be given later.

In molding, some other processing may be applied to the case 38, if necessary. For example, the stopper 38*c* may be provided which abuts against the stopper 34*c* of the rotor 34 and controls revolution thereof. Also, at the back of the case 38 may be formed three grooves 38*d* to house the terminals 28, 29 and 30 when bent towards the back thereof.

In addition, preferably the arched idle electrode 27*c* is provided at the outside of the resistor 24 on the surface of the substrate, as shown in FIG. 2, in such a way that the idle electrode 27*c* is on the same level as other parts, thereby preventing gap from being created between a mold and the level of the parts, with the result being that resin does not flow thereinto in molding.

Figure 3:
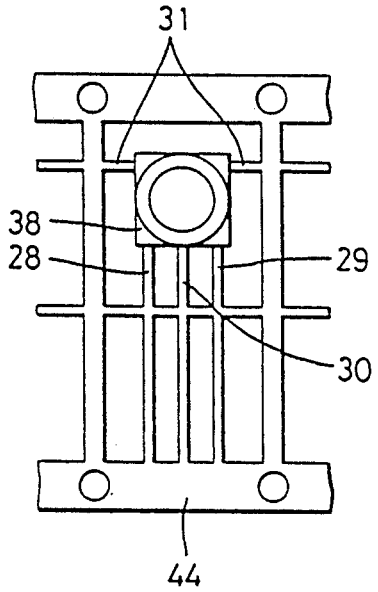
FIG. 3 is a plan view showing one example of a case formed of hoop material.

Moreover, the above-described case 38 side may be molded continuously when using the hoop material 44, as shown in FIG. 3. Reference numeral 31 designates the idle terminal to hold the case 38 and the like on the hoop material.

Figure 4:
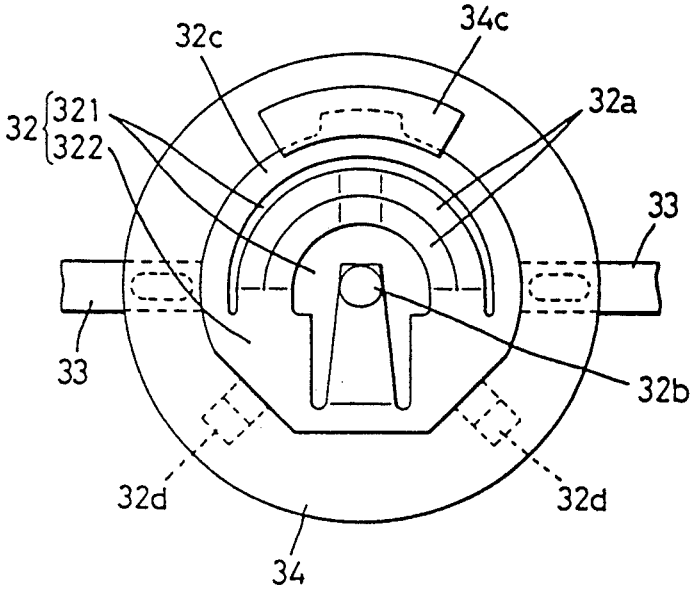
FIG. 4 is a plan view showing a rotor, as seen from the bottom, used for a variable resistor in FIG. 1.

Now the rotor 34 side is described referring also to FIG. 4. The circular rotor 34 made of insulating resin is provided, to which the sliding member 32 is secured at the under surface thereof, the member connecting the above-described resistor 24 and the collector electrode 26. In this example, the sliding member is also molded at the under surface of the rotor. Preferably, such heat-resistant resin as PPS resin may be used as material for the rotor 34. Reasons are therefore given later.

In addition, some processing may be applied to the rotor 34 at the time of molding. For example, the stopper 34*c* described above may be provided. Moreover, the convex 34*a* and the cross-shaped driver-engaging groove 34*b* may be provided in the central part.

The sliding member 32 in this example is formed by bending a piece of a metal plate. Its lower part 321 is completely flat-shaped and the upper plate 322 has the sliding points 32*a* and 32*b*, the point 32*a* being arched and comprising two strips with the central part thereof rising and end portion of the point 32*b* also rising. Both of the sliding points 32*a* and 32*b* have elasticity and, in the case 38, the point 32*a* is in contact with the resistor 24 on the substrate 22 and the point 32*b* is in contact with the collector electrode 26, respectively. Reference numeral 32*d* is a reinforcing piece to prevent the sliding member from coming off.

Figure 5:
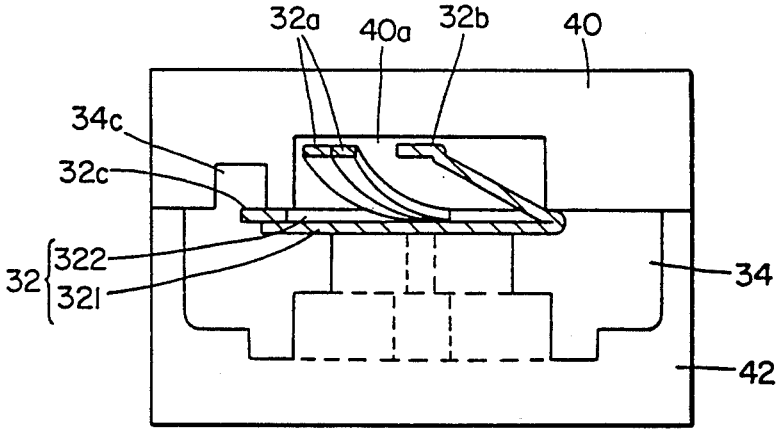
FIG. 5 is a vertical section showing one example of how a sliding member is being inserted to a rotor.

One example of how the above-described sliding member 32 is molded at the rotor 34 is shown in FIG. 5, reference numeral 40 being an upper part and 42 a lower part, wherein the lower plate 321 of the sliding member is flat, as described above, and serves as a sealing lid so that resin at the time of molding is prevented from flowing into the cavity 40*a* of the upper part 40. Apparently, with the use of such a sliding member having the folded construction, molding is carried out with ease.

Substantially ring-shaped idle plate 32*c* is provided along the outer periphery of the sliding point 32*a* of the upper plate, whereby a difference in the level of the plane due to the thickness of the bent plate is eliminated to prevent leakage of the resin even when no particular process is applied to the upper part 40. Accordingly, the upper part is easily processed.

Figure 6:
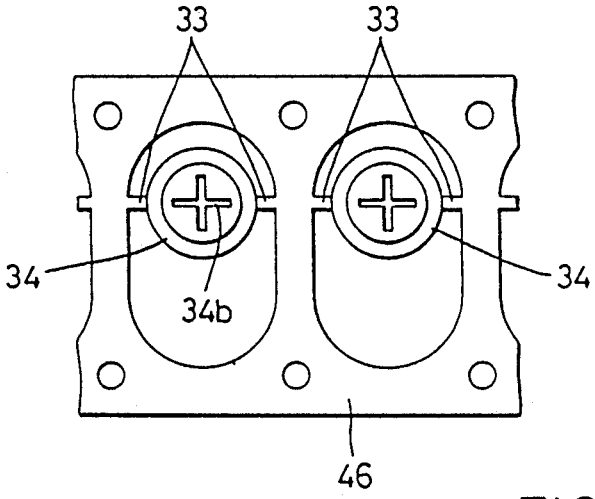
FIG. 6 is a partly cutaway plan view showing one example of how a rotor is formed using hoop material.
Figure 7:
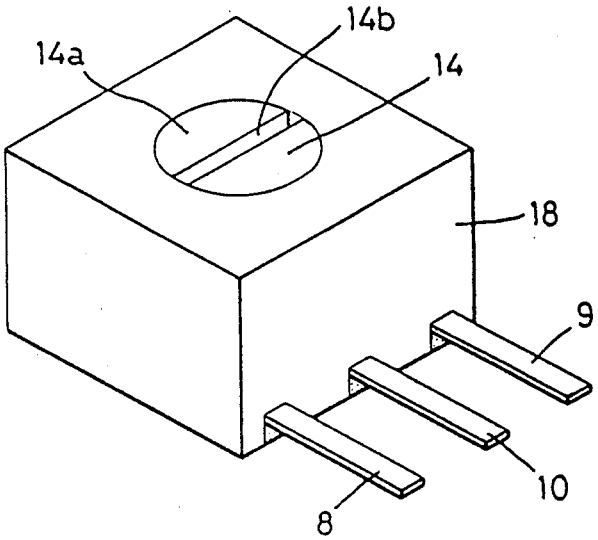
FIG. 7 (PRIOR ART)
FIG. 7 is a perspective view showing the conventional variable resistor.
Figure 8:
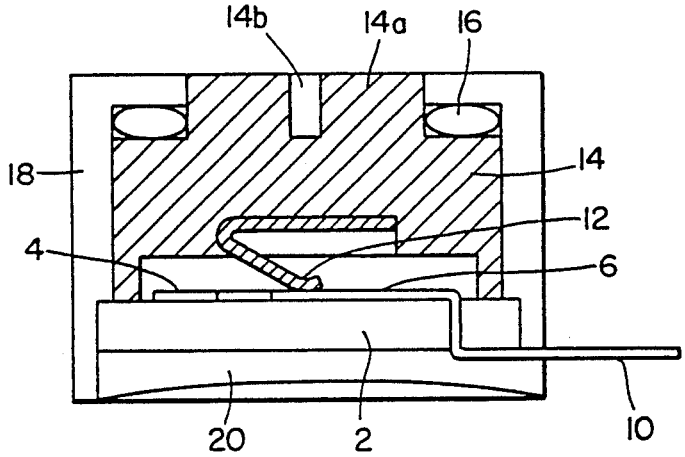
FIG. 8 (PRIOR ART)
FIG. 8 is a vertical section of FIG. 7.

It will be appreciated that the rotor 34 side described above can be continuously molded when the hoop material 46, for example, as shown in FIG. 6, is used. The connecting piece for the sliding member to hold the rotor 34 on the hoop material 46 is designated at 33.

In such a case as described above, it is preferable that a pitch of the rotor 36 on the hoop material 46 is the same as that of the case 38 side on the hoop material 44, so as to facilitate continuous assembling.

Now FIG. 1 is again referred to. After making, for example, the case 38 side held by the hoop material 44 and the rotor 34 side held by the hoop material 46, respectively, the rotor is rotatably fitted into the opening 38*a* of the case 38 with the sliding member 32 underneath. However the connecting piece for the sliding member is cut off and removed immediately before fitting in so as not to interrupt revolution.

When a sealed-type variable resistor is preferred, the packing 36 like O ring may be inserted, as shown in FIG. 1. As is apparent from the structure of this embodiment, non-sealed type variable resistor may be obtained by removing the packing, without changing other components, thereby facilitating switching of the manufacturing process from a sealed-type resistor to non-sealed one.

The lip 38*b* of the opening of the case 38 is deformed inward by heat forming to cover the convex part 34*a* of the rotor in such a manner as to ensure the rotatable operation of the rotor while preventing the rotor from coming out of the case. In this instance, as described before, it is preferable to set the deforming temperature of the resin, of which the case is formed, lower than that of the rotor 34, so that the rotor remains unaffected by deformation and the like due to heat-forming.

Then, the terminals 28, 29 and 30 connected to the hoop material 44 may be cut to the length required (at this time, the idle terminal 31 has not been cut yet), and, in addition, as the need arises, each of the terminals 28, 29 and 30 may be bent to the rear side of the case 38 as shown in by the dashed line in FIG. 1 to rise in the groove 38*d* with a necessary pitch, whereby a variable resistor of top adjustment type may be obtained. In such an instance, each groove 38*d* may be formed at both sides at suitable points to cover the terminals so as to prevent them from coming up. Alternately, seal resin may be used for reinforcement. If preferred, as shown by the solid line in FIG. 1, each of the terminals 28, 29 and 30 may be extended transversely without being bent as above described. The variable resistor thus obtained is of a side adjustment type. Also, in this way, a chip-type (surface mounted type) variable resistor can be obtained.

And finally, when the idle terminal 31 of the hoop material 44 is cut off and eliminated, the variable resistor shown in FIG. 1 is obtained. By applying the above-described processes one by one with respect to the case 38 side and the rotor 34 side, each on the hoop materials 44 and 46, respectively, such a variable resistor can be assembled in succession.

In the case of the variable resistor shown in FIG. 1, when the rotor 34 is rotated to the right or left by the driver-engaging groove 34*b*, the sliding point 32*a* of sliding member slides on the resistor 24 under the condition that the sliding point 32*b* of the member 32 is in contact with the collector electrode 26 on the substrate 22, with the result being that the resistance value between the terminals 30 and 28 or 29 can be changed.

Thus, in the variable resistor of this embodiment, the substrate 22 is secured by molding to the bottom of the case 38, and the rotor 34 is rotatably held within the case 38 due to inward molding of the lip 38 while prevented from coming off therefrom. In short, for the variable resistor according to this invention, conventional use of seal resin is not required in order to retain the rotor and to secure the substrate.

It will be appreciated that all the problems subsequent to the use of the seal resin are now solved by this invention. That is, controlling the injection amount of the seal resin and heating for curing thereof is eliminated, no hole is created in the seal resin, so that, whether it is a sealed-type or unsealed-type, the variable resistor is superior in productivity, simple in manufacturing arrangements and easy to automatically assemble. Furthermore, when molding is applied, not only to the case 38 side but to the rotor 34 side, as in this embodiment, it will reduce the number of parts in assembling to improve considerably its productivity.

In the manufacturing method of this embodiment, since a potting operation and heating process for curing the seal resin is not required, the variable resistor described above can be produced with excellent productivity and assembled in an automatic fashion.

In addition, as in the case of this embodiment, when both the case 38 side and the rotor 34 side are continuously molded using the hoop materials 44 and 46 and then a variable resistor is assembled with the use thereof, each part can be easily and precisely positioned with the result being that the variable resistor can be mass-produced and more easily automated.

A preferred embodiment has been described above wherein on the rotor 34 side the sliding member 32 has also been molded. Such molding is not necessarily required for the sliding member. The member may be secured to the under surface of the rotor 34 by other means, for example, by fitting in and the like.

What is claimed is:

1. A variable resistor comprising:

a casing having a bottom wall and a plurality of side walls extending from said bottom wall and defining an opening opposed to said bottom wall, said casing being made of an insulating resin;

an insulating substrate having a first surface disposed along said bottom wall of said casing within said casing and a second surface opposite said first surface;

a curved resistor layer formed on said second surface of said insulation substrate;

a collector electrode layer formed on said second surface of said insulating substrate, said collector electrode layer being spaced from said curved resistor layer and located at a center of said curved resistor layer;

a rotor member having a first surface and an opposite second surface, said rotor member being rotatably disposed in said casing with said first surface of said rotor member opposed to and spaced from said second surface of said insulating substrate, and having a rotational axis around which said rotor member is rotatable extending through said collector electrode layer;

a slidable member connected to said first surface of said rotor member and slidably engaged with said curved resistor layer and said collector electrode layer, said slidable member for electrically connecting said curved resistor layer and said collector electrode layer; and first, second and third electrodes extending from said casing and electrically connected to one end of said curved resistor layer, to another end of said curved resistor layer, and to said collector electrode layer, respectively;

said plurality of side walls extending inwardly towards said rotational axis defined by said rotor member at said opening of said casing so as to rotatably secure said rotor member within said casing.

2. A variable resistor as recited in claim 1, wherein said slidable member is metallic and comprises:

a planar upper plate connected along said first surface of said rotor member;

a lower plate connected to said planar upper plate and having portions overlapping said planar upper plate, said lower plate further having a first member extending to and slidably engaged with said curved resistor layer and a second member extending to and slidably engaged with said collector electrode layer.

3. A variable resistor as recited in claim 1, further comprising:

a curved idle electrode layer formed on said second surface of said insulating substrate at an outer periphery of said second surface of said insulating substrate and spaced from said curved resistor layer, said curved idle electrode layer preventing a flow of insulating resin along said second surface of said insulating substrate towards said curved resistor layer during molding of said casing.

4. A variable resistor as recited in claim 2, further comprising:

said curved idle electrode layer formed on said second surface of said insulating substrate at an outer periphery of said second surface of said insulating substrate and spaced from said curved resistor layer, said curved idle electrode layer preventing a flow of insulating resin along said second surface of said insulating substrate towards said curved resistor layer during molding of said casing.

5. A variable resistor as recited in claim 1, wherein a deformation temperature of said casing is less than a deformation temperature of said rotor member.

6. A variable resistor as recited in claim 2, wherein a deformation temperature of said casing is less than a deformation temperature of said rotor member.

7. A variable resistor as recited in claim 3, wherein a deformation temperature of said casing is less than a deformation temperature of said rotor member.

8. A variable resistor as recited in claim 4, wherein a deformation temperature of said casing is less than a deformation temperature of said rotor member.

9. A variable resistor as recited in claim 1, wherein said bottom wall of said casing and said plurality of side walls of said casing are an integral unit.

10. A variable resistor as recited in claim 2, wherein said bottom wall of said casing and said plurality of side walls of said casing are an integral unit.

11. A variable resistor as recited in claim 3, wherein said bottom wall of said casing and said plurality of side walls of said casing are an integral unit.

12. A variable resistor as recited in claim 4, wherein said bottom wall of said casing and said plurality of side walls of said casing are an integral unit.

13. A variable resistor as recited in claim 5, wherein said bottom wall of said casing and said plurality of side walls of said casing are an integral unit.

14. A variable resistor as recited in claim 6, wherein said bottom wall of said casing and said plurality of side walls of said casing are an integral unit.

15. A variable resistor as recited in claim 7, wherein said bottom wall of said casing and said plurality of side walls of said casing are an integral unit.

16. A variable resistor as recited in claim 8, wherein said bottom wall of said casing and said plurality of side walls of said casing are an integral unit.

17. A method of manufacturing a variable resistor, said method comprising:

forming a curved resistor layer and a collector electrode layer on a first surface of an insulating substrate, the collector electrode layer being spaced from the curved resistor layer and formed at a center of the curved resistor layer, the insulating substrate having a second surface opposite the first surface;

molding the insulating substrate onto an inner bottom surface of a casing made of an insulating resin such that the second surface of the insulating substrate is disposed along the bottom surface of the casing, the casing having a plurality of side walls extending upwardly from the bottom surface and having an opening defined by the plurality of side walls opposed to the bottom surface;

connecting a sliding member to a surface of a rotor body;

inserting the rotor body into the casing such that the sliding member is slidably connected to the curved resistor layer and to the collector electrode layer;

heating at least one of the plurality of side walls at the opening of the casing to form the at least one of the plurality of side walls around a portion of the rotor body to rotatably secure the rotor body within the casing.

18. A method as recited in claim 17, wherein said forming step further includes forming a curved idle electrode layer on the first surface of the insulating substrate at an outer periphery of the first surface of the insulating substrate and spaced from the curved resistor layer, the curved idle resistor layer preventing a flow of insulating resin along the second surface of the insulating substrate towards the curved resistor layer during said molding step.

19. A method as recited in claim 17, wherein said connecting step further includes:

forming the sliding member by providing a metallic device having a planar upper plate and an overlapping planar lower plate, the lower plate having a first metallic member for slidably connecting to the curved resistor layer and a second metallic member for slidably connecting to the collector electrode layer, and by bending the first and second metallic members of the lower plate away from the upper plate;

molding the sliding member to the surface of the rotor body such that the upper plate of the sliding member is disposed along the surface of the rotor body.

20. A method as recited in claim 18, wherein said connecting step further includes:

forming the sliding member by providing a metallic device having a planar upper plate and an overlapping planar lower plate, the lower plate having a first metallic member for slidably connecting to the curved resistor layer and a second metallic member for slidably connecting to the collector electrode layer, and by bending the first and second metallic members of the lower plate away from the upper plate;

molding the sliding member to the surface of the rotor body such that the upper plate of the sliding member is disposed along the surface of the rotor body.

* * * * *